US011429065B2

(12) United States Patent
Bossart et al.

(10) Patent No.: US 11,429,065 B2
(45) Date of Patent: Aug. 30, 2022

(54) METHOD OF MANUFACTURING A CLOCK OR WATCH COMPONENT

(71) Applicant: ROLEX SA, Geneva (CH)

(72) Inventors: Richard Bossart, Mont-la-Ville (CH); Nima Merk, Lausanne (CH)

(73) Assignee: ROLEX SA, Geneva (CH)

( * ) Notice: Subject to any disclaimer, the term of this patent is extended or adjusted under 35 U.S.C. 154(b) by 0 days.

(21) Appl. No.: 16/202,284

(22) Filed: Nov. 28, 2018

(65) Prior Publication Data

US 2019/0171164 A1 Jun. 6, 2019

(30) Foreign Application Priority Data

Dec. 5, 2017 (EP) ..... 17205320

(51) Int. Cl.

| | |
|---|---|
| ***G04B 19/04*** | (2006.01) |
| ***G04B 15/14*** | (2006.01) |
| ***G04B 13/02*** | (2006.01) |
| ***G04B 17/06*** | (2006.01) |

(52) U.S. Cl.

CPC ..... *G04B 19/042* (2013.01); *G04B 13/026* (2013.01); *G04B 15/14* (2013.01); *G04B 17/066* (2013.01)

(58) Field of Classification Search

None

See application file for complete search history.

(56) References Cited

U.S. PATENT DOCUMENTS

| | | | | |
|---|---|---|---|---|
| 7,618,183 | B2 * | 11/2009 | Meister | B81C 99/008 368/324 |
| 2014/0341005 | A1 | 11/2014 | Hessler | |
| 2015/0309474 | A1 * | 10/2015 | Bossart | B81C 1/00682 428/596 |

(Continued)

FOREIGN PATENT DOCUMENTS

| | | | |
|---|---|---|---|
| CN | 101625541 | A | 1/2010 |
| CN | 103988133 | A | 8/2014 |
| CN | 104126152 | A | 10/2014 |

(Continued)

OTHER PUBLICATIONS

European Search Report and Written Opinion dated May 31, 2018 issued in counterpart application No. EP17205320; w/ English machine translation (11 pages).

(Continued)

*Primary Examiner* — Stephanie P Duclair

(74) *Attorney, Agent, or Firm* — WHDA, LLP

(57) ABSTRACT

A method of manufacturing a clock or watch component (19; 29) includes (i) providing (E11; E21) a wafer (11; 21) having a single slice (12; 22) including a material of the component, notably silicon, diamond, quartz, sapphire or ceramic, optionally first coating the lower surface of the slice (22) with a lower layer (24), (iii) etching (E12 to E14; E22 to E24) the slice (12; 22) starting from its upper surface to form at least one clock or watch component, (iv) revealing (E15; E25) at least one clock or watch component (19; 29), by removing a layer that served as a mask for etching (E15; E25) and (y) optionally releasing (E26) the slice and the at least one etched clock or watch component by removing the lower layer (24).

33 Claims, 2 Drawing Sheets

(56) References Cited

U.S. PATENT DOCUMENTS

| | | | | |
|---|---|---|---|---|
| 2017/0131684 | A1* | 5/2017 | Cusin | B44C 1/227 |
| 2017/0371300 | A1* | 12/2017 | Ikeda | G04B 15/14 |

FOREIGN PATENT DOCUMENTS

| | | | |
|---|---|---|---|
| CN | 105000530 | A | 10/2015 |
| CN | 105705458 | A | 6/2016 |
| CN | 105711326 | A | 6/2016 |
| CN | 105717753 | A | 6/2016 |
| CN | 105960612 | A | 9/2016 |
| EP | 0 732 635 | A1 | 9/1996 |
| EP | 2320281 | A2 | 5/2011 |
| EP | 2579105 | A2 | 4/2013 |
| WO | 2013/087173 | A1 | 6/2013 |
| WO | 2016/093354 | * | 6/2016 |

OTHER PUBLICATIONS

Office Action dated Jul. 6, 2020, issued in counterpart EP application No. 17 205 320.9. (4 pages).
Office Action dated Jul. 5, 2021, issued in counterpart CN Application No. 201811474412.3, with English Translation. (23 pages).

* cited by examiner

METHOD OF MANUFACTURING A CLOCK OR WATCH COMPONENT

This application claims priority of European patent application No. N° N° EP17205320.9 filed Dec. 5, 2017, which is hereby incorporated by reference herein in its entirety.

The present invention relates to a method of manufacturing a clock or watch component carried out starting from a micro-machinable material.

Manufacture of clock and watch components starting from a micro-machinable material such as silicon and by micromachining techniques, notably by dry etching, for example by deep reactive ion etching (DRIE) or by chemical wet etching, is known.

Figure 1:
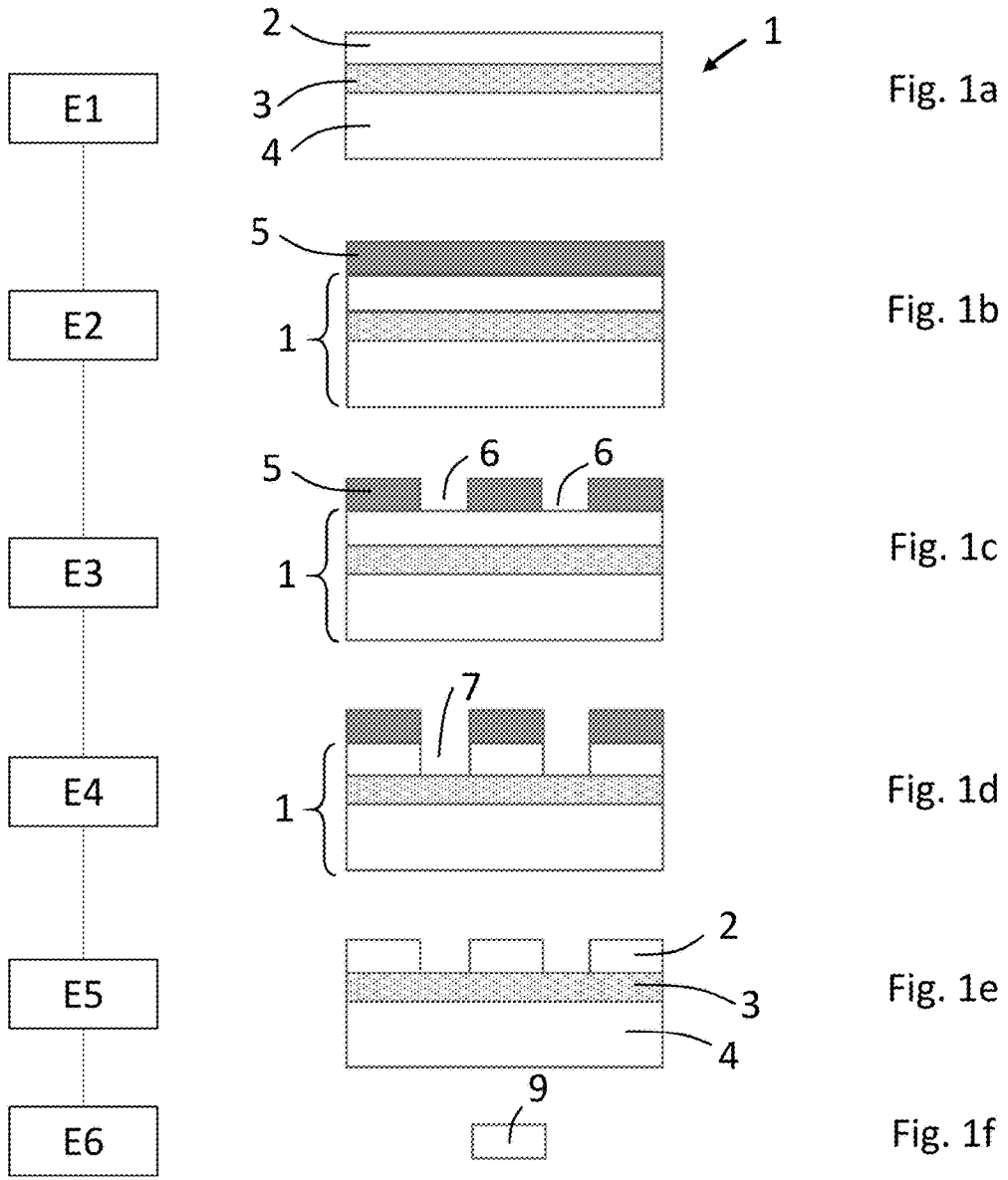

A method of manufacture of this kind from the prior art, shown in FIG. 1, comprises a first step E1 (FIG. 1*a*) consisting of providing a wafer 1, consisting of a first slice 2 of micro-machinable material, for example of silicon, with thickness corresponding to that of the final component, of the order of 10 to 200 microns, and intended to be worked to form the component. This first slice 2 is assembled on a second slice 4, with thickness of the order of 0.5 mm, intended to serve as a support and also for example made of silicon, via an intermediate layer 3 of silicon oxide. A wafer 1 of this kind is generally called "wafer SOI" for "wafer silicon on insulator". The second slice 4 and the intermediate layer 3 thus form a support, which keeps the whole wafer 1 rigid, allowing it to be handled without risk, and to be manipulated easily during manufacture of the clock or watch component.

The method of manufacture then comprises a step consisting of adding a mask on the visible face of the wafer 1, by depositing (step E2, FIG. 1*b*) a layer of resin 5, in which free zones 6 are formed (step E3, FIG. 1*c*) by partial removal of the resin by photolithography techniques. Note that the general term "wafer" will be used to denote a slice or an assembly of slices, and/or optionally comprising additional layers, used in a method of manufacture comprising at least one etching operation, starting from a masking step corresponding to step E2. This wafer comprises two faces: the visible face, which shall also be called upper surface by convention, which will be etched, and the lower face.

The mask formed in the preceding step then allows the formation of at least one clock or watch component, by etching (step E4, FIG. 1*d*) the first slice 2 of the wafer 1 in the resin-free zones 6. The component(s) is/are thus formed according to geometry determined by the mask formed previously.

Finally, the remaining resin is removed (step E5, FIG. 1*e*), then the at least one clock or watch component 9, illustrated in FIG. 1*f*, is obtained by separating the first slice 2 from the second slice 4 in a release step E6. This release step therefore has the effect of separating the clock or watch component or components, etched in the first slice 2, from the intermediate layer 3, but also from the micro-machinable material that the second slice 4 consists of. This release step E6 is a complex step. It may be carried out by completely dissolving the material of the intermediate layer 3 starting from the upper face of the wafer 1, more precisely starting from the etchings 7 made in the first slice 2 of the wafer 1, which has the drawback that the step is of very long duration. As a variant, it is possible to release selectively, starting from the lower face of the wafer 1 and in the second slice 4, the spaces located underneath the clock or watch components formed, by manufacturing steps similar to steps E2 to E5 described above carried out on the wafer that has been turned over, so as to make the intermediate layer 3 more accessible and accelerate its dissolution. In all cases, the release step E6 is long and requires complex manufacturing equipment, which is an important drawback of the solution in the prior art.

One aim of the present invention is to propose a method of manufacturing a clock or watch component that improves the method of the prior art.

More particularly, the aim of the present invention is to propose a simplified method of manufacturing a clock or watch component.

For this purpose, the invention is based on a method of manufacturing a clock or watch component, characterized in that it comprises the following steps:

- providing a wafer comprising a slice comprising a material of the component, notably silicon, diamond, quartz or ceramic,
- optionally first coating the lower surface of said slice with a lower layer,
- etching said slice of the wafer starting from its upper surface to form at least one clock or watch component,
- revealing at least one clock or watch component, by removing a layer that served as a mask for etching,
- and optionally releasing said slice and the at least one etched clock or watch component by removing the lower layer.

The step consisting of providing a wafer may comprise a step consisting of providing a wafer with thickness approximately equal to the maximum thickness of the clock or watch component to be manufactured.

The method may comprise a step of etching the material of the component in the full thickness of the whole of the material of the component present in the wafer and/or in the full thickness of the single slice comprising the material of the component of the wafer.

The invention is defined more precisely by the claims.

These aims, features and advantages of the present invention will be presented in detail in the following description of particular nonlimiting embodiments in relation to the appended figures, where:

FIG. 1 is a schematic representation of the steps of manufacture of a clock or watch component according to the prior art.

Each of FIGS. 1*a* to 1*f* shows more precisely a manufacturing step according to the prior art.

Figure 2:
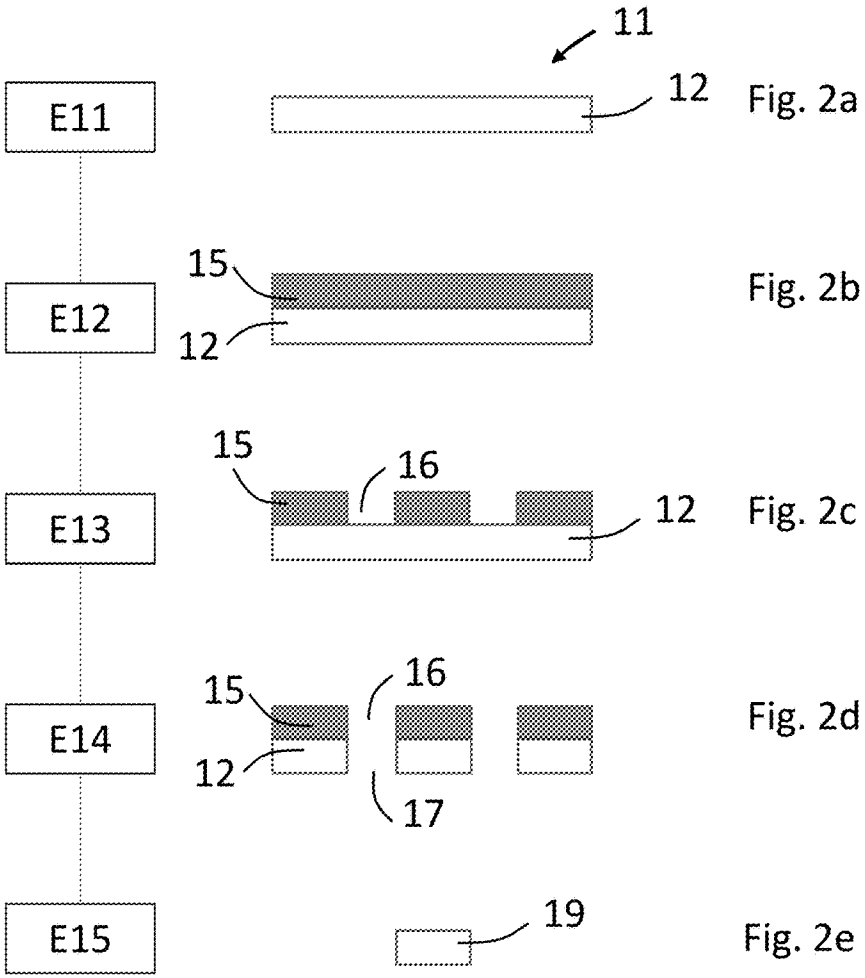

FIG. 2 is a schematic representation of the steps of manufacture of a clock or watch component according to a first embodiment of the invention.

Each of FIGS. 2*a* to 2*e* shows more precisely a manufacturing step according to the first embodiment of the invention.

Figure 3:
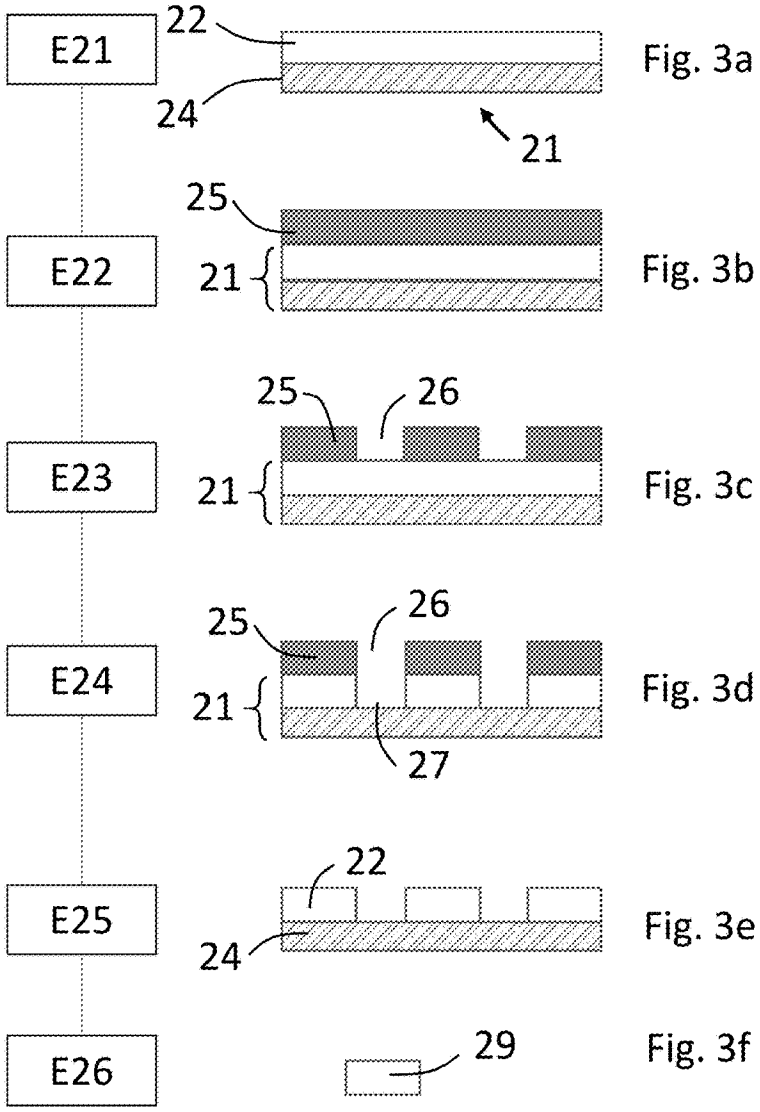

FIG. 3 is a schematic representation of the steps of manufacture of a clock or watch component according to a second embodiment of the invention.

Each of FIGS. 3*a* to 3*f* shows more precisely a manufacturing step according to the second embodiment of the invention.

According to the embodiments of the invention, the method of manufacturing a clock or watch component is improved in that it greatly simplifies the end of the method of the prior art, by simplifying or even by eliminating the release step E6 described above. By convention, as mentioned above, the adjective upper shall be used to denote a surface of the side of the face of a wafer that will undergo the first etching, and the adjective lower for a surface of an opposite side.

FIG. 2 shows a method of manufacturing a clock or watch component according to a first embodiment of the invention.

Like the method of the prior art described above, a method of manufacture of this kind comprises a first step E11 (FIG. 2*a*) consisting of providing a wafer 11 made of micro-machinable material, for example silicon. According to this embodiment, a wafer of this kind comprises a single slice 12 intended to be worked to form the clock or watch component. This single slice 12 preferably has a thickness greater than or equal to 100 microns, or even greater than or equal to 120 microns. This thickness may notably be between 100 or 120 microns and 300 microns, or even up to 500 microns.

The method of manufacture then comprises a step consisting of adding a mask on the upper surface of the wafer 11, by depositing (step E12, FIG. 2*b*) a layer of resin 15, in which free zones 16 are formed (step E13, FIG. 2*c*) by partial removal of the resin by photolithography techniques.

The mask formed in the preceding step then allows formation of at least one clock or watch component, by etching (step E14, FIG. 2*d*) the wafer 11 through the free zones 16 of the resin mask. The component(s) is/are thus formed according to geometry determined by the mask formed previously. Preferably, attachements are provided for keeping the component(s) attached to the wafer 11.

Finally, the resin that remains is removed by dissolution, in a development step (step E15, FIG. 2*e*) for directly obtaining the machined slice 12 comprising the clock or watch component(s) 19.

Steps E12 to E15 correspond approximately to steps E2 to E5 of the solution of the prior art, and therefore are not described in detail. Notably, the etching is carried out conventionally, by photolithography and DRIE. The great advantage of this first embodiment of the invention is that the second supporting slice of the wafer has been eliminated, making it possible to eliminate the tedious release step E6 of the prior art by dissolution of the intermediate layer 3.

As a variant, the wafer 11 made of micro-machinable material could be in the form of several superposed layers, and/or made of several materials. The important feature of the embodiment is that the wafer does not comprise any layer the function of which is limited to forming a support and that it is etched in its whole thickness. In other words, the clock or watch component obtained has a maximum final thickness approximately equal to the thickness of the wafer 11 used, i.e. to the thickness of the slice 12.

Thus, the embodiment described above certainly allows considerable simplification of the method of manufacturing a clock or watch component. It is mainly based on eliminating any support in a wafer 11 made of micro-machinable material, and on the unexpected finding that it is possible to manufacture a clock or watch component starting from a slice that does not comprise a support.

FIG. 3 shows a method of manufacturing a clock or watch component according to a second embodiment of the invention.

A method of manufacture of this kind comprises a first step E21 (FIG. 3*a*) consisting of providing a wafer 21 comprising a micro-machinable material, for example silicon. According to this second embodiment, a wafer of this kind 21 comprises a slice 22 made of micro-machinable material, which corresponds to the material of the clock or watch component, with a thickness greater than or equal to 100 microns, or even greater than or equal to 120 microns, intended to be worked to form the clock or watch component. The wafer 21 further comprises a lower, preferably metallic, layer 24.

Thus, this second embodiment comprises a preliminary step, not shown, consisting of depositing or assembling a metallic lower layer 24 on a slice 22 made of micro-machinable material, to form the wafer 21. According to a first embodiment, this preliminary step consists of coating a surface of a slice made of micro-machinable material with a layer of metal deposited by a technique of physical vapor deposition (PVD). As an example, a metallic lower layer of this kind may be a layer of pure aluminum of 2 microns. As a variant, said lower layer may have any other thickness, preferably between 0.5 and 5 microns inclusive. Alternatively, any technique for depositing a pure metal and/or an alloy may be used for coating the lower surface of the slice made of micro-machinable material with a metallic layer. Preferably, the metal deposited is aluminum, gold or platinum. Additionally, it is possible to deposit a keying coat beforehand on the slice made of micro-machinable material, for example of titanium or of chromium, to improve the adhesion of the metallic lower layer. As a variant, any other technique of deposition or of assembly of a metallic lower layer forming a coating on the surface of the slice made of micro-machinable material may be used (e.g. electrolytic growth, chemical vapor deposition, gluing a sheet, etc.).

The method of manufacture then comprises a step consisting of adding a mask on the upper surface of the wafer 21, by depositing (step E22, FIG. 3*b*) a layer of resin 25, in which free zones 26 are formed (step E23, FIG. 3*c*) by partial removal of the resin by photolithography techniques.

The mask formed in the preceding step then allows formation of at least one clock or watch component, by etching (step E24, FIG. 3*d*) the wafer 21 through free zones 26 of the resin mask. The component(s) is/are thus formed according to geometry determined by the mask formed previously.

Finally, the resin that remains is removed by dissolution, in a development step (step E25, FIG. 3*e*). Steps E22 to E25 correspond approximately to steps E2 to E5 and E12 to E15.

The method according to this second embodiment then comprises a release step E26 (FIG. 3*f*), which consists of removing the metallic lower layer 24. This release step E26 is very simple and quick: it is carried out by dissolving the metal, for example in a bath of aluminum etching acid (mixture of $HNO_3$, $H_3PO_4$, $CH_3COOH$, $H_2O$). The composition of the bath must be adapted to the metal of the lower layer, to allow it to be dissolved, in a manner known by a person skilled in the art. Thus, the material of the lower layer is dissolved completely. In the solution of the prior art mentioned above, only the intermediate layer 3 of silicon oxide is dissolved, and the second lower slice 4 of silicon then separates from the upper slice bearing the components.

Thus, this second embodiment is still very simple, since the final separation of the clock or watch component 29, by eliminating the manufacturing residues such as the resin and the lower layer, which is in the form of a metallic supporting layer according to one embodiment, comprises a release step E26 that is greatly simplified relative to the method of the prior art, which uses a support consisting of two parts, one of which corresponds to the material of the component, and which cannot thereby be dissolved chemically without first protecting the components etched in the first slice with an additional layer.

Thus, the second embodiment described above certainly allows considerable simplification of the method of manufacturing a clock or watch component. It is based on the use of a metallic support for a slice consisting of a micro-machinable material, and on the unexpected finding that it is possible to manufacture a clock or watch component starting from a wafer comprising a single slice of micro-machinable material and a thin metallic lower layer, much thinner than the support in the prior art, which is also made of micro-machinable material. A person skilled in the art would have had a negative prejudice to such a solution, notably considering that the metal would diffuse in the micro-machinable material, altering its properties. A person skilled in the art would also have a negative prejudice regarding the feasibility of this method of manufacture, as the treatment equipment is generally designed for wafers of a certain rigidity to ensure precision and robustness.

Note that relative to the first embodiment, the metallic lower layer used in this second embodiment also offers the following additional advantages:

- it serves as a barrier layer in the etching step E24, and protects the slice holder by preventing it being exposed to ion bombardment at the end of etching;
- it removes the heat produced in the structures during etching (exothermic chemical reaction+ion bombardment);
- it also makes it possible to avoid the defects that may sometimes appear at the bottom of the etching, often called "notching";
- it protects the lower face of the layer made of micro-machinable material, i.e. the slice, and holds the etched components on their entire surface, preventing deformation of the flexible structures during the etching operation.

This second embodiment has been described on the basis of a lower layer of metal. As a variant, it is also possible to deposit or grow a layer of silicon oxide $SiO_2$ or of polymer, for example a polymer film of poly-p-xylylene, better known by the name Parylene, on the lower face of the slice made of micro-machinable material, which notably fulfils the same stiffening function as a metallic layer. The release step E26 will simply consist of dissolution of the layer of $SiO_2$ or of polymer by means of acids such as mixtures based on hydrofluoric acid or by plasma oxygen treatment.

Finally, the concept implemented in the two embodiments of the invention described above consists of proposing a method of manufacturing a clock or watch component that does away with the step of release of a support made of micro-machinable material, which is complex and time-consuming, by avoiding the use of a micro-machinable material as a support. In other words, the whole of the thickness of the micro-machinable material present in the wafer is used for forming the clock or watch component, without any supporting function. Therefore it does not comprise a slice of micro-machinable material used only for the function of support: the single slice of micro-machinable material present in the wafer 11, 21 is intended to form at least one clock or watch component by etching. Thus, in the preceding embodiments, the method does not comprise etching of micro-machinable material on the lower face of the wafer to facilitate the release step E6, but only etching on the upper face. The clock or watch component obtained preferably has a maximum thickness corresponding approximately to the thickness of the whole micro-machinable material (corresponding to the sum of the thickness of all the layers made of micro-machinable material in the case of a multilayer slice) initially present in the wafer serving for its manufacture.

As a variant, the method of manufacturing a clock or watch component may also comprise additional treatment steps, carried out before or after release of the component from the resin and/or from the metallic support, such as thinning of the slice of micro-machinable material or of the component, mechanical or laser-beam reworking, coating, thermal treatment of oxidation, cleaning/degreasing, etc.

Quite obviously, the method of the invention applies to the manufacture of a great many clock or watch components. The clock or watch component may be an entity ready to be mounted in a movement (for example a lever, a spring, etc.) or a component intended to be assembled on one or more other components of the movement (for example a balance spring on the balance staff, a wheel plate on its spindle, a pallet on the pallet staff (or spindle), a balance wheel on the balance staff, etc.). Alternatively, the clock or watch component may be an external component, such as a hand. This method is particularly suitable for manufacturing simple clock or watch components 2.5 D (two-and-a-half dimensions), with thickness greater than or equal to 100 μm. The second embodiment will be preferred for the more fragile components that have thin structures, which risk being broken, or the more flexible components, which risk being deformed during the etching step, such as spiral springs, or the thinnest components, notably with a thickness of less than 100 microns. The first embodiment will be preferred for components that are less fragile, notably more massive, such as wheels, as well as for components with a thickness strictly greater than 100 μm. However, both embodiments are still suitable for manufacturing all these clock or watch components.

In the embodiment examples described above, the deposited layer that serves as a mask for etching is made of a light-sensitive resin. This layer of light-sensitive resin may be replaced with any other layer that can serve as a mask against etching of the DRIE type, for example a layer of silicon oxide, silicon nitride, a metallic layer, etc. A person skilled in the art will select the layer that is suitable for his/her needs.

In the embodiments of the invention described above, "micro-machinable material" means any material suitable for micromachining, notably including any material that can be etched directionally through a mask. Moreover, micro-machining means all of the techniques allowing structures of micrometric size to be produced in a material through a mask, for example such as chemical etching or photolithography. The micro-machinable material used in the embodiment examples described above is silicon, but doped silicon, porous silicon, etc. may be used instead. Other micro-machinable materials could of course be used, for example diamond, quartz, sapphire and ceramics. It may also be a hybrid material. The micro-machinable material may also be any microstructurable material, sufficiently rigid to be manipulated. Thus, the invention is suitable more generally for manufacturing a clock or watch component consisting of or comprising a material called "material of the component" that can be cut through a mask. Advantageously, this material of the component will be worked starting from a slice of thickness greater than or equal to 100 μm, arranged within a wafer, as explained in the embodiments described, or more generally in a wafer comprising a layer comprising one or more material(s) of the component of which the whole thickness, preferably greater than or equal to 100 μm, will be etched to form the component. Moreover, a wafer of this kind may optionally comprise a support in another material, notably a metal or a metal alloy, called material of the support, different than the material of the component and compatible with it, i.e. not affected during etching of the material of the component, such as execution of the etching steps E14, E24 described above. Advantageously, the thickness of the optional support is very small, less than or equal to 10 μm, or even less than or equal to 5 μm, or even less than or equal to 3 μm. Moreover, this thickness is preferably greater than or equal to 0.5 μm. This thickness is therefore regarded as negligible relative to the thickness of the slice of material of the component, of the wafer, and of the clock or watch component manufactured.

The invention claimed is:

1. A method of manufacturing a clock or watch component, the method comprising:

providing a wafer comprising a single slice comprising a material of the component, first coating a lower surface of the slice with a stiff lower layer, etching only the slice of the wafer starting from an upper surface of the wafer to the lower surface of the slice that is above the stiff lower layer to form at least one clock or watch component, revealing the at least one clock or watch component, by removing a mask layer that served as a mask for etching, the mask layer being made of a different material than a material of the stiff lower layer, releasing the slice and the at least one etched clock or watch component by removing the stiff lower layer, and having the lower layer serve as a supporting layer for manipulating during manufacture, wherein the material of the supporting layer is more rigid than the material of the mask layer, wherein the method further includes after said coating of the lower surface of the slice with the stiff lower layer adding a mask on the upper surface of the wafer having free zones for formation of the clock or watch component during said etching.

2. The method of manufacturing the clock or watch component as claimed in claim 1, wherein the providing of the wafer comprises providing the wafer having a thickness approximately equal to a maximum thickness of a clock or watch component to be manufactured.

3. The method of manufacturing the clock or watch component as claimed in claim 1, wherein the etching of the slice of the wafer comprises etching the material of the component of the slice in a full thickness of a whole of the material of the component present in the wafer and/or in a full thickness of the slice of the wafer.

4. The method of manufacturing the clock or watch component as claimed in claim 1, wherein the providing of the wafer comprises providing the wafer consisting of the slice alone in the material of the component.

5. The method of manufacturing the clock or watch component as claimed in claim 4, wherein the slice has a thickness greater than or equal to 100 microns.

6. The method of manufacturing the clock or watch component as claimed in claim 1, wherein the method comprises coating the lower surface of the slice with the stiff lower layer that is metallic, or of silicon oxide $SiO_2$ or of polymer film.

7. The method of manufacturing the clock or watch component as claimed in claim 6, wherein the coating comprises coating the lower surface of the slice with the stiff lower layer of metal deposited on the slice or assembled on the slice.

8. The method of manufacturing the clock or watch component as claimed in claim 7, wherein the metal of the stiff lower layer is at least one selected from the group consisting of aluminium, gold and platinum, and the metal is deposited on the slice by a technique of physical vapor deposition or of chemical vapor deposition or of electrolytic growth.

9. The method of manufacturing the clock or watch component as claimed in claim 6, wherein the coating comprises coating the lower surface of the slice with the stiff lower layer having a thickness less than or equal to 10 μm.

10. The method of manufacturing the clock or watch component as claimed in claim 9, wherein the thickness of the stiff lower layer is less than or equal to 5 μm.

11. The method of manufacturing the clock or watch component as claimed in claim 6, wherein the method comprises releasing the slice and the at least one etched clock or watch component by removing the stiff lower layer of the material of the component from the wafer.

12. The method of manufacturing the clock or watch component as claimed in claim 6, wherein the stiff lower layer is metallic.

13. The method of manufacturing the clock or watch component as claimed in claim 12, wherein the stiff lower layer contains aluminium, gold or platinum.

14. The method of manufacturing the clock or watch component as claimed in claim 1, wherein the slice of the wafer has a thickness less than or equal to 500 microns.

15. The method of manufacturing the clock or watch component as claimed in claim 14, wherein the slice of the wafer has a thickness less than or equal to 300 microns.

16. The method of manufacturing the clock or watch component as claimed in claim 1, wherein the method comprises performing a subsequent thermal treatment of oxidation, and/or of cleaning/degreasing of the at least one clock or watch component.

17. The method of manufacturing the clock or watch component as claimed in claim 1, wherein the method comprises manufacturing an entity for a clock or watch movement or manufacturing an entity for a cover component.

18. The method of manufacturing the clock or watch component as claimed in claim 1, wherein the material of the component comprises at least one selected from the group consisting of silicon, diamond, quartz, sapphire and ceramic.

19. The method of manufacturing the clock or watch component as claimed in claim 1, wherein the etching of the slice of the wafer comprises making fasteners allowing temporary holding of the at least one etched clock or watch component on the slice in which it is etched.

20. The method of manufacturing the clock or watch component as claimed in claim 1, wherein the material of the component is at least one selected from the group consisting of silicon, diamond, quartz, sapphire and ceramic.

21. The method of manufacturing a clock or watch component as claimed in claim 1, wherein the stiff lower layer extends across an entire area of the lower layer such as to be free of apertures extending there-through.

22. The method of manufacturing a clock or watch component as claimed in claim 1, wherein the stiff lower layer is not etched.

23. The method of manufacturing a clock or watch component as claimed in claim 1, wherein said stiff lower layer is made of micromachinable material that is sufficiently rigid to hold etched components and to prevent deformation during etching.

24. The method of manufacturing a clock or watch component as claimed in claim 1, wherein etching of the method only includes said etching of only the slice of the wafer starting from an upper surface of the wafer to the lower surface of the slice that is above the stiff lower layer to form at least one clock or watch component and does not include etching of support material on the lower surface face of the wafer.

25. The method of manufacturing a clock or watch component as claimed in claim 1, wherein said revealing the at least one clock or watch component, by removing said mask layer is performed prior to said releasing the slice and the at least one etched clock or watch component by removing the stiff lower layer.

26. The method of manufacturing a clock or watch component as claimed in claim 1, wherein the method includes coating the lower surface of the slice with the stiff lower layer that comprises a polymer film of poly-p-xylylene.

27. The method of manufacturing a clock or watch component as claimed in claim 1, further including having the stiff lower layer serve as a barrier layer during said etching.

28. The method of manufacturing a clock or watch component as claimed in claim 1, further including performing said removing of the stiff lower layer by dissolving of the stiff lower layer after said etching.

29. The method of manufacturing a clock or watch component as claimed in claim 28, further including having stiff lower layer serve as a barrier layer during said etching.

30. The method of manufacturing a clock or watch component as claimed in claim 1, further including:

a) wherein the stiff lower layer is metallic; and b) wherein the coating comprises coating the lower surface of the slice with the stiff lower layer having a thickness less than or equal to 10 μm.

31. A method of manufacturing a clock or watch component, the method comprising:

providing a wafer comprising a single slice comprising a material of the component, first coating a lower surface of the slice with a stiff lower layer, etching only the slice of the wafer starting from an upper surface of the wafer to the lower surface of the slice that is above the stiff lower layer to form at least one clock or watch component, revealing the at least one clock or watch component, by removing a mask layer that served as a mask for etching, the mask layer being made of a different material than a material of the stiff lower layer, releasing the slice and the at least one etched clock or watch component by removing the stiff lower layer, and having the stiff lower layer serve as a barrier layer during said etching, wherein the method further includes after said coating of the lower surface of the slice with the stiff lower layer adding a mask on the upper surface of the wafer having free zones for formation of the clock or watch component during said etching.

32. A method of manufacturing a clock or watch component, the method comprising:

providing a wafer comprising a single slice comprising a material of the component, first coating a lower surface of the slice with a stiff lower layer, etching only the slice of the wafer starting from an upper surface of the wafer to the lower surface of the slice that is above the stiff lower layer to form at least one clock or watch component, revealing the at least one clock or watch component, by removing a mask layer that served as a mask for etching, the mask layer being made of a different material than a material of the stiff lower layer, releasing the slice and the at least one etched clock or watch component by removing the stiff lower layer, and having the lower layer serve as a supporting layer for manipulating during manufacture, wherein the material of the supporting layer is more rigid than the material of the mask layer, wherein the method further includes:

a) wherein the stiff lower layer is metallic; and b) wherein the coating comprises coating the lower surface of the slice with the stiff lower layer having a thickness less than or equal to 10 μm.

33. A method of manufacturing a clock or watch component, the method comprising:

providing a wafer comprising a single slice comprising a material of the component, first coating a lower surface of the slice with a stiff lower layer, etching only the slice of the wafer starting from an upper surface of the wafer to the lower surface of the slice that is above the stiff lower layer to form at least one clock or watch component, revealing the at least one clock or watch component, by removing a mask layer that served as a mask for etching, the mask layer being made of a different material than a material of the stiff lower layer, releasing the slice and the at least one etched clock or watch component by removing the stiff lower layer, and having the stiff lower layer serve as a barrier layer during said etching, wherein the method further includes:

a) wherein the stiff lower layer is metallic; and b) wherein the coating comprises coating the lower surface of the slice with the stiff lower layer having a thickness less than or equal to 10 μm.

* * * * *